United States Patent [19]

Pracht

[11] Patent Number: 4,570,512

[45] Date of Patent: Feb. 18, 1986

[54] CORK SCREW HAVING A BELL-SHAPED HOUSING

[75] Inventor: Günther Pracht, Solingen, Fed. Rep. of Germany

[73] Assignee: August Reutershan GmbH. & Co. KG, Solingen, Fed. Rep. of Germany

[21] Appl. No.: 679,421

[22] Filed: Dec. 6, 1984

[30] Foreign Application Priority Data

Dec. 22, 1983 [DE] Fed. Rep. of Germany ..... 3346414

[51] Int. Cl.[4] ..... B67B 7/18

[52] U.S. Cl. ..... 81/3.29

[58] Field of Search ..... 81/3.29, 3.45, 3.36, 81/3.48

[56] References Cited

U.S. PATENT DOCUMENTS

| | | | |
|---|---|---|---|
| 2,342,156 | 2/1944 | Miller | 81/3.29 |
| 2,522,219 | 9/1950 | Gaeta | 81/3.29 |
| 4,135,415 | 1/1979 | Liebscher et al. | 81/3.29 |

FOREIGN PATENT DOCUMENTS

| | | | |
|---|---|---|---|
| 7701338 | 8/1977 | Netherlands | 81/3.48 |

*Primary Examiner*—James L. Jones, Jr.

*Attorney, Agent, or Firm*—John C. Smith, Jr.

[57] ABSTRACT

With a cork screw having a bell-shaped housing with which a cork can be lifted out of the neck of a bottle without reversing the turning direction of the cork-screw blade and which is provided with a sleeve-like body with which the cork screw is firmly put on the neck of the bottle to be uncorked in order to lift out the cork, the lifting of the cork out of the bottle to be uncorked is often made difficult because the cork-screw blade is not centered. In order to avoid this disadvantage, there is guided in the sleeve-like body a spring-loaded piston which is located near the lower end of the sleeve-like body when the cork-screw blade is driven into the cork and through which the cork-screw blade passes centrally with a slight clearance.

2 Claims, 5 Drawing Figures

FIG. 1
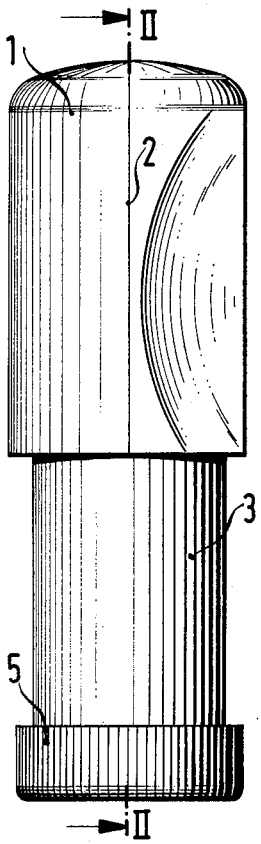
FIG. 2
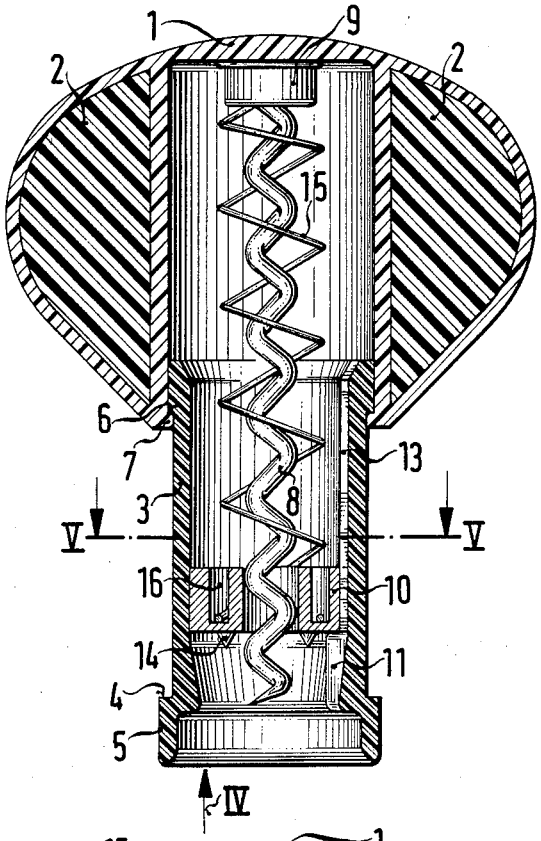
FIG. 5
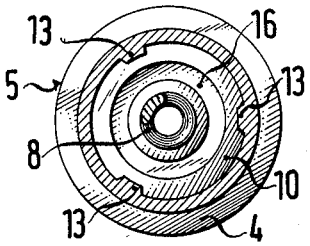
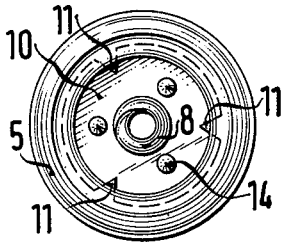
FIG. 4
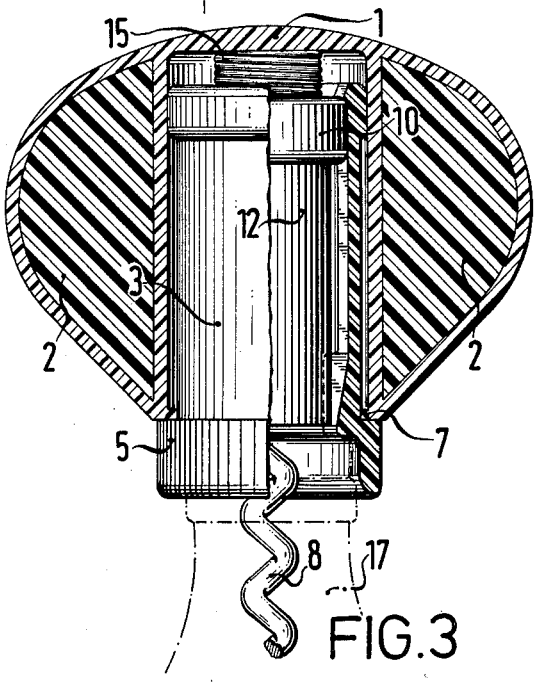
FIG. 3

CORK SCREW HAVING A BELL-SHAPED HOUSING

BACKGROUND OF THE INVENTION

This invention relates to a cork screw having a bell-shaped housing and a cork-screw blade which is secured at one of its ends to the closed end of the bell-shaped housing, the cork being able to be lifted out of the neck of a bottle without reversing the turning direction of the cork-screw blade.

From German Patent Specification No. 26 05 679 and British Patent Specification No. 1,548,050 a cork screw is known in which the shaft of the cork-screw blade is surrounded by a spirally wound spring which is fixedly connected at one of its ends to the shaft of the cork-screw blade and at its other end is pushed into a bore hole provided in the closed end of a capsule-shaped body and starting from a passage hole for the shaft of the cork-screw blade, the capsule-shaped body, provided with an external thread, being guided in the bell-shaped housing having an internal thread. In the case of such a cork screw the cork-screw blade is not centered during driving it into the cork so that it cannot be excluded that the cork-screw blade is driven obliquely into the cork. This, however, can have the result that the cork breaks and cannot be lifted out in such an unfavorable case. Furthermore, the cork-screw blade projects beyond the capsule-shaped body when it is not in use so that injuries to the user of the cork screw are possible.

SUMMARY OF THE INVENTION

It is the object of the present invention to avoid the above-mentioned disadvantages and to provide a cork screw having a bell-shaped housing in which the cork-screw blade is compulsorily centered when it is applied to the cork to be lifted out and is completely accommodated, ready for being screwed in, in the cork screw when it is not in use.

To attain this object the present invention provides a cork screw having a bell-shaped housing and a cork-screw blade which is secured at one of its ends to the closed end of the bell-shaped housing, the cork being able to be lifted out of a bottle neck without reversing the turning direction of the cork-screw blade, which comprises (a) a sleeve-like body on which the bell-shaped housing is guided and which has at its lower end a collar with which the cork screw grips around the upper end of the neck of a bottle to be uncorked when the cork screw has been placed on the neck of the bottle, and (b) a spring-loaded piston which is guided in the sleeve-like body of the cork screw and which at the beginning of driving the cork-screw blade into the cork is adjacent to the lower end of the sleeve-like body, the cork-screw blade passing centrally through said piston with clearance and in the starting position reaching with its free end nearly up to the lower end of the sleeve-like body.

The cork-screw blade which, after the collar of the sleeve-like body has been firmly put on the neck of the bottle to be uncorked, is driven into the cork by turning and shifting the bell-shaped housing on the sleeve-like body under the exertion of a slight pressure on the bell-shaped housing, is compulsorily centered from the beginning of the driving-in operation on so that a safe break-free detaching of the cork from the neck of the bottle is ensured. When the cork-screw blade is driven out of the cork, the bell-shaped housing is again shifted into the starting position with the aid of the previously tensioned and now relaxing spring, the cork-screw blade being taken along until its free end is again accommodated in the sleeve-like body. In this position of rest of the cork-screw blade injuries at its tip are avoided.

An advantageous development of the invention is one in which the piston is guided in the sleeve-like body in such a manner that it is secured against rotation and has at its end face facing the lower end of the sleeve-like body fixedly arranged tapering pins.

When the cork is being lifted out the pins penetrate the upper end face thereof. Thereby and by the guidance of the piston in the sleeve-like body in a manner secured against rotation, a rotation of the cork when drawing it into the sleeve-like body and when driving the cork-screw blade out of the lifted out cork is avoided.

BRIEF DESCRIPTION OF THE DRAWING

An embodiment of the invention will now be described by way of example and with reference to the accompanying drawing in which:

FIG. 1 is a side elevational view of a cork screw according to the present invention;

FIG. 2 is a longitudinal sectional view on the line II—II of FIG. 1;

FIG. 3 is a view similar to that shown in FIG. 2 but with the cork being lifted out of the bottle to be uncorked;

FIG. 4 is an underneath view in the direction of the arrow A in FIG. 2, and FIG. 5 a cross-sectional view on the line V—V of FIG. 2.

DESCRIPTION OF THE PREFERRED EMBODIMENT

FIGS. 1 and 2 show a cork screw having a bell-shaped housing 1 made of plastic material and consisting of two longitudinal halves welded together. The bell-shaped housing 1 has two opposite arms 2 formed integrally therewith which are directed sideways and form a tommy handle. The bell-shaped housing 1 is so arranged on a sleeve-like body 3 of plastic material that it is axially shiftable and rotatable thereon. The sleeve-like body 3 is formed at its lower end, via a shoulder 4, with a collar 5, whereas a circular shoulder 6 is formed adjacent to its upper end. Furthermore, the bell-shaped housing 1 is formed at the lowermost portion of its inner circumference with a circular shoulder 7 which is intended alternately to cooperate with the shoulders 4 and 6 in order to limit the shifting movements of the bell-shaped housing 1. A cork-screw blade 8 which is formed helix-shaped over its entire length is firmly anchored at one of its ends in a hub 9 integrally formed with the closed end of the bell-shaped housing 1. A piston 10 is guided in the sleeve-like body 3. This piston 10 is in the starting position near to the lower end of the sleeve-like body 3. The reference numeral 11 denotes sharp-edged ribs (see also FIG. 4) which are integrally formed with the inner circumference of the sleeve-like body 3, start from the lower end of the said body 3 and extend obliquely upwardly. These ribs 11 serve the purpose of forming a stop for the piston 10, on the one hand, and, on the other hand, prevent rotation of a cork 12 when it is drawn into the sleeve-like body 3. The ribs 11 are followed in the direction towards the upper end of the sleeve-like body 3 by trapezoidal ribs 13 (FIG. 5) which are likewise integral parts of the sleeve-like body 3 and guide the piston 10 in a manner secured against rotation with the aid of recesses provided in the circumference of the piston 10 and corresponding in cross section to the ribs 13. The piston 10 has at its end face facing the lower end of the sleeve-like body 3 fixedly arranged tapering pins 14 and is under the pressure force of a compression spring 15 surrounding the cork-screw blade 8. The spring 15 has one of its ends inserted in a circular recess 16 of the piston 10, whereas its other end is pushed onto the hub 9 and rests against the closed end of the bell-shaped housing 1. The cork-screw blade 8 passes centrally through the piston 10 with a slight clearance and extends in its position of rest with its free end approximately up to the lower end of the sleeve-like body 3. The reference numeral 17 denotes the neck of a bottle which is shown by dash-and-dot lines in FIG. 3.

The mode of operation of the cork screw is as follows:

The collar 5 of the sleeve-like body 3 of the cork screw is firmly put on the neck 17 of a bottle to be uncorked. Between the free end of the cork-screw blade 8 and the upper end face of the cork there remains only a small free space. The bell-shaped housing 1 is then turned clockwise on the sleeve-like body 3, by simultaneously exerting a slight pressure with one hand of the person using the cork screw, and at the same time shifted so far in downward direction until it engages with its circular shoulder 7 the shoulder 4 of the collar 5 of the sleeve-like body 3. In doing so, the cork-screw blade 8 is compulsorily driven centrally into the cork 12 and at the same time the spring 15 is further compressed. When the bell-shaped housing 1 is further turned clockwise, the cork 12 is lifted out of the neck 17 of the bottle and drawn into the sleeve-like body 3 against the piston 10 because of the firm seating of the sleeve-like body 3 on the neck 17 of the bottle, the tapering pins 14 of the piston 10 being forced into the cork 12. The piston 10 is shifted by the cork 12 against the force of the compression spring 15 in the direction towards the upper end of the sleeve-like body 3. After the cork 12 has been lifted out of the neck 17 of the bottle, the cork-screw blade 8 is driven out of the cork 12. For this purpose, the collar 5 of the body 3 of the cork screw is taken with the other hand of the person using the cork screw and the bell-shaped housing 1 is turned counterclockwise and moved back into its starting position with the aid of the compression spring 15. When the starting position has been reached, the cork-screw blade 8 has been driven out of the cork 12 and the latter is thus removed from the cork-screw blade 8. The piston 10 released from the cork 12 is then shifted under the pressure force of the compression spring 15 back into its starting position in which it rests under the force of the compression spring 15 against the upper ends of the ribs 11.

The invention may be embodied in other specific forms without departing from the spirit or essential characteristics thereof. The embodiment is therefore to be considered in all respects as illustrative and not restrictive.

What is claimed is:

1. A cork screw having a bell-shaped housing and a cork-screw blade which is secured at one of its ends to the closed end of the bell-shaped housing, the cork being able to be lifted out of a bottle neck without reversing the turning direction of the cork-screw blade, comprising (a) a sleeve-like body (3) on which the bell-shaped housing (1) is guided and which has at its lower end a collar (5) with which the cork screw grips around the upper end of the neck (17) of a bottle to be uncorked when the cork screw has been placed on the neck of the bottle, and (b) a spring-loaded piston (10) which is guided in the sleeve-like body (3) of the cork screw and which at the beginning of driving the cork-screw blade (8) into the cork is adjacent to the lower end of the sleeve-like body, the cork-screw blade passing through a central passage-hole in said piston with clearance and in the starting position reaching with its free end nearly up to the lower end of the sleeve-like body.

2. A cork screw having a bell-shaped housing as claimed in claim 1, wherein the piston (10) is guided in the sleeve-like body (3) in such a manner that it is secured against rotation and has at its end face facing the lower end of the sleeve-like body fixedly arranged tapering pins (14).

* * * * *